United States Patent [19]

Bury

[11] 4,373,483

[45] Feb. 15, 1983

[54] LUBRICATING OIL PUMP DRIVE FOR AN INTERNAL COMBUSTION ENGINE

[75] Inventor: Cecil T. Bury, Huddersfield, England

[73] Assignee: David Brown Tractors Ltd., Huddersfield, England

[21] Appl. No.: 239,237

[22] Filed: Mar. 3, 1981

[30] Foreign Application Priority Data

Mar. 19, 1980 [GB] United Kingdom ..... 8009307

[51] Int. Cl.[3] ..... F02B 77/14

[52] U.S. Cl. ..... 123/198 C; 123/195 A; 123/196 R

[58] Field of Search ..... 123/198 C, 195 A, 196 R

[56] References Cited

U.S. PATENT DOCUMENTS

| | | | |
|---|---|---|---|
| 3,384,063 | 5/1968 | Moulton et al. | 123/198 C |
| 3,643,642 | 2/1972 | Junes | 123/198 C |
| 3,781,137 | 12/1973 | Engstrom | 123/198 C |
| 4,295,807 | 10/1981 | Kruger | 123/198 C |
| 4,334,508 | 6/1982 | Sasaki | 123/198 C |
| 4,334,836 | 6/1982 | Kubis et al. | 123/198 C |

*Primary Examiner*—Ira S. Lazarus

[57] ABSTRACT

Lubricating oil pumps for internal combustion engines have hitherto had individual drive means such as a pair of skew gears. To simplify and cheapen the pump drive means, the pump is of the internal gear type and is driven by and housed within an idler gear driveably connecting the crankshaft to the camshaft. The pump body is rigidly secured to the engine and has a cylindrical periphery on which the idler gear is journalled, and the externally-toothed inner gear of the pump is driveably connected to the idler gear by a coupling sleeve.

5 Claims, 1 Drawing Figure

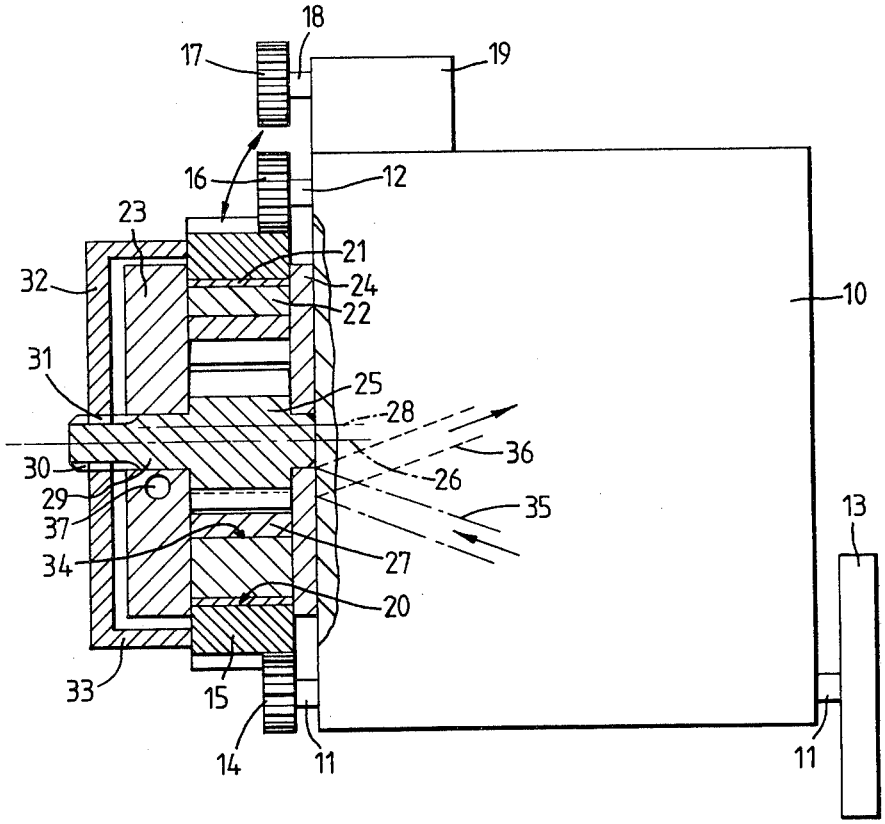
18
17
19
16
12
23
21
32
24
22
10
31
25
28
36
30
26
29
35
13
37
34
27
20
33
15
14
11
11

LUBRICATING OIL PUMP DRIVE FOR AN INTERNAL COMBUSTION ENGINE

BACKGROUND OF INVENTION

The invention relates to lubricating oil pump drive means for an internal combustion engine.

Hitherto, an engine lubricating oil pump has commonly been immersed in the sump oil and driven from an intermediate point on the camshaft by means of a pair of skew gears. In spark ignition engines the same drive means have generally been utilised also for the distributor, but in compression ignition engines where no distributor is required the lubricating oil pump has still been provided with individual drive means of this or some equivalent kind.

The object of the present invention is to simplify and thus cheapen the drive means of an engine lubricating oil pump, particularly but not exclusively for a compression ignition engine.

SUMMARY OF INVENTION

According to the invention, in an internal combustion engine having a train of toothed gears including an idler gear driveably connecting its crankshaft to its camshaft, its lubricating oil pump is driven by the idler gear.

BRIEF DESCRIPTION OF DRAWING

A preferred embodiment of the invention will now be described, by way of example, with reference to the accompanying drawing which is a diagrammatic side elevation of a diesel engine with the cross-hatched components at its left-hand end shown greatly enlarged.

DESCRIPTION OF PREFERRED EMBODIMENT

Referring now to the drawing, a diesel engine has a crankcase 10 in which there are journalled in parallel relationship to one another a crankshaft 11 and a camshaft 12. To insure that these shafts rotate in the necessary timed relationship with one another they are driveably connected together, outside the crankcase 10 and at that end thereof remote from the engine flywheel 13, by a train of toothed gears comprising a gear 14 fixed on a projecting end of the crankshaft 11 and meshed with an idler gear 15, and a gear 16 fixed on a projecting end of the camshaft 12 and also meshed with the idler gear 15. The train of toothed gears includes another gear 17 meshed with the idler gear 15 and fixed on the drive shaft 18 of an ancillary fuel injection pump 19 mounted externally on the crankcase 10, which pump must also operate in timed relationship with the crankshaft 11 and camshaft 12. The idler gear 15 has a bore 20 of large diameter journalled on a bearing bush 21 surrounding a cylindrical portion 22 of the body of an engine lubricating oil pump, and said portion and respective end plate portions 23 and 24 of said body are rigidly secured together and to the crankcase 10. Said pump is of the well-known internal gear type, that is to say comprises an externally toothed inner member 25 rotateable in the body about a first axis 26 and meshing with an internally toothed outer member 27 having one tooth more than the inner member and rotateable in the body about a second axis 28 somewhat offset from and parallel to the first axis 26, either one of said members but usually the inner one being power driven. In the present case the inner member 25 is integral with a short shaft 29 journalled in the end plate portions 23 and 24, that end of said shaft remote from the crankcase 10 projecting from the associated end plate portion 23 and having external splines 30 which engage internal splines 31 formed in a radially-inwardly-extending flange 32 on a coupling sleeve 33 rigidly secured to the idler gear 15. Thus said first axis 26 of the engine lubricating oil pump coincides with the axis of the idler gear 15, and said second axis 28 of said pump co-incides with the axis of an eccentric bore 34 in the cylindrical portion 22 of the body of said pump in which bore there is journalled the outer periphery of the outer member 27 of said pump. Inlet and outlet ports are provided in that end plate portion 24 adjacent the crankcase 10, the inlet port communicating with a suction conduit 35 formed in the crankcase 10 and leading to the engine sump and the outlet port communicating with a delivery conduit 36 formed in the crankcase 10 and leading to a main oil gallery of the engine. A relief valve 37 is provided in that end plate portion 23 remote from the crankcase 10 so as to be accessible for adjustment, and is capable of returning oil from the outlet side to the inlet side of the engine lubricating oil pump. The train of toothed gears 14, 15, 16 and 17 including said pump is enclosed within a cover plate (not shown) removeably secured to the crankcase 10.

Thus separate drive means for said pump, such as a pair of skew gears, are eliminated.

I claim:

1. An internal combustion engine having a train of toothed gears including an idler gear driveably connecting its crankshaft to its camshaft, wherein its lubricating oil pump is of the internal gear type and is housed within and driven by said idler gear.

2. An internal combustion engine according to claim 1, wherein suction and delivery conduits for the oil pump are formed in the engine casing.

3. An internal combustion engine according to claim 1, wherein a relief valve capable of returning oil from the outlet side to the inlet side of the oil pump is disposed on that side of said pump remote from the engine casing.

4. An internal combustion engine according to claim 1, wherein the oil pump includes a body rigidly secured to the engine and having a cylindrical periphery on which the idler gear is journalled.

5. An internal combustion engine according to claim 1, wherein the oil pump includes an externally-toothed inner gear driveably connected to the idler gear by a coupling member.

* * * * *